United States Patent [19]

Brandt

[11] Patent Number: 4,891,025

[45] Date of Patent: Jan. 2, 1990

[54] ARRANGEMENT IN BOAT PROPELLER INSTALLATIONS

[75] Inventor: Lennart Brandt, Fjärås, Sweden

[73] Assignee: AB Volvo Penta, Gothenburg, Sweden

[21] Appl. No.: 165,114

[22] Filed: Mar. 7, 1988

[30] Foreign Application Priority Data

Mar. 27, 1987 [SE] Sweden ..... 8701282

[51] Int. Cl.[4] ..... B63H 21/32

[52] U.S. Cl. ..... 440/66; 440/89

[58] Field of Search ..... 440/66, 88, 89; 114/67 A, 289; 416/90 A, 91, 92

[56] References Cited

U.S. PATENT DOCUMENTS

| | | | |
|---|---|---|---|
| 2,570,509 | 10/1951 | Bandli | 440/89 |
| 3,434,447 | 3/1969 | Christensen et al. | 440/66 |
| 3,745,964 | 7/1973 | Henrich | 440/66 |
| 4,383,829 | 5/1983 | Allen, Jr. et al. | 440/66 |
| 4,545,771 | 10/1985 | Iio | 440/89 |

FOREIGN PATENT DOCUMENTS

| | | |
|---|---|---|
| 2224344 | 10/1974 | France . |
| 392698 | 4/1977 | Sweden . |
| 19047 | of 1909 | United Kingdom . |

*Primary Examiner*—Sherman D. Basinger
*Assistant Examiner*—Jesûs D. Sotelo
*Attorney, Agent, or Firm*—Young & Thompson

[57] ABSTRACT

The invention relates to an arrangement in propeller installations including means for supplying motor exhaust gases to the vicinity of the propeller (7). The invention is characterized in that a gas outlet (4) is located immediately forwards of the propeller and directs the gas flow towards the sweep of the blade tips of the propeller.

3 Claims, 1 Drawing Sheet

ARRANGEMENT IN BOAT PROPELLER INSTALLATIONS

Figure 1:
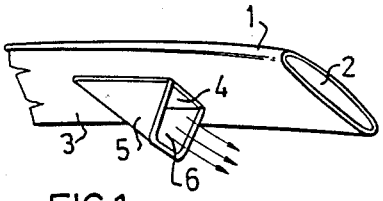

The present invention relates to an arrangement in boat propeller installations, comprising a device for supplying a gaseous medium to the vicinity of a propeller whose blades pass close to a wall structure, such as the bottom of a boat or a cavitation plate.

It is often difficult to accelerate a boat which is intended for planing, rapidly beyond the planing threshold, i.e. the transition zone of high wave-resistance, or drag resistance, at which the boat churns up water. The margin between the thrust which the propeller can produce at full throttle and the resistance curve of the boat is very narrow at the planing threshold. This margin is liable to decrease if weight is added to the boat or if the boat is subjected to additional resistance, e.g., from water skiers or head winds, which result in a lowering of the acceleration ability and, in extreme cases, may render it impossible to pass the planing threshold, due to the fact that the braking moment exerted by the water on the propeller prevents the motor from "reving up" to the speed at which maximum power is reached.

One known fundamental solution by means of which the braking moment can be reduced and the propeller thrust increased when necessary involves fitting the propeller with adjustable blades, the pitch of which can be decreased when the boat resistance increases. Such a solution is both technically complicated and expensive, however.

Another known fundamental solution involves introducing air or exhaust gases into the propeller region, in order to reduce the viscosity of the water around the propeller blades, so as to lower the drag resistance and enable the propeller to revolve more freely. A number of auxiliary solutions have been proposed in this regard. In accordance with one such solution, exhaust gases are delivered through a nozzle to the propeller hub, either continuously or to a progressively decreasing extent as the speed of the boat increases. According to another solution, a separate air or gas nozzle is located forwardly of the propeller blades on a level with the effective radius of the blades, i.e. 0.7 radian. This solution affords a structurally simpler and less expensive design than that afforded by a solution which requires the provision of adjustable propeller blades. However, this latter solution provides greater possibilities of optimizing thrust than the solution in which gas is introduced into the vicinity of the propeller hub or at the effective blade radius.

With a starting point from the known technique of injecting a gaseous medium towards the propeller, the object of the present invention is to provide in fast boats, or watercraft, an arrangement by means of which propeller thrust can be increased comparably with the increase obtainable with propellers having adjustable blades.

This object is achieved in accordance with the invention with an arrangement of the kind mentioned in the introduction, in which the device for supplying the gaseous medium has an outlet which is located in the wall structure and which is configured to direct a flow of gas towards the sweep of the tips of the propeller blades, and in which arrangement means are provided for controlling the amount of gas supplied.

The invention is based on the understanding that the relative (helical) blade speed is very high close to the blade tip. In the case of a propeller intended for a known inboard/outboard installation, the helical blade speed may be between 60 and 70 knots at the effective radius, wherewith the helical tip speed may be between 85 and 95 knots. Cavitation is unavoidable at speeds as high as these, and a cavitational bubble will form at the blade tips. By introducing a gaseous medium, such as air or exhaust gas, into a zone which is passed by the blade tips, it is possible to induce the cavitation bubble to grow, so as to reduce primarily the lifting force of the blade tips. This enables the propeller to revolve more freely in the water and to "rev up" more, which in turn enables the motor speed, and therewith the power delivered to the propeller, to increase. Should the blade tip hypercavitate as a result of the gas supply to the sweep of the propeller tips, the effectiveness of the propeller (lifting force/resistance) will still be good and its efficiency still high, which for higher motor power output also means greater thrust.

Figure 2:
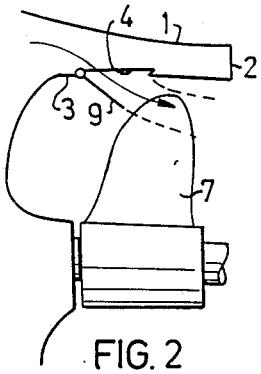
Figure 3:
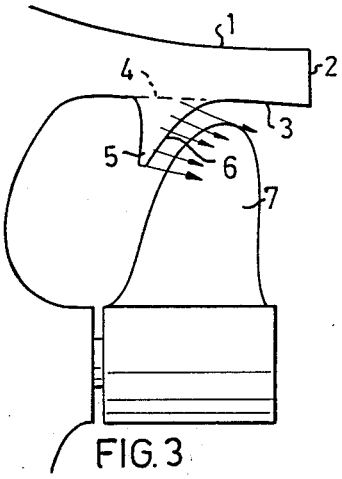
Figure 5:
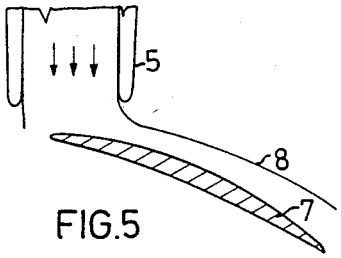
Figure 4:
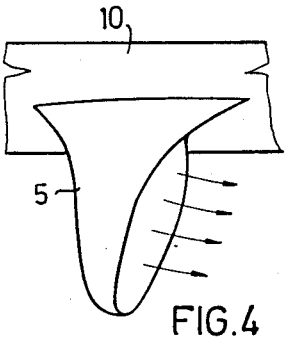

The invention will now be described in more detail with reference to some embodiments thereof illustrated in the accompanying drawing, in which FIG. 1 is a schematic perspective view of a cavitation plate which incorporates a gas outlet, FIGS. 2 and 3 are respective schematic side views of propeller installations in which the gas outlets have mutually different configurations, FIG. 4 is a schematic view in perspective of a gas outlet fitted to the bottom of a boat; and FIG. 5 is a cross-sectional view of a propeller blade seen from behind a gas outlet.

In FIGS. 1–3 the reference 1 identifies a cavitation plate which is hollow and forms an exhaust duct which incorporates an outlet 2 through which exhaust gases are normally released. Located in the undersurface 3 of the plate 1 is an opening 4 which is surrounded by a hood or cowl 5 (FIGS. 1 and 3) and through which part of the exhaust gases can be released. The outlet orifice 6 of the cowl 5 is located immediately forwards of the tips of a propeller 7, so that as the blade tips pass by, the exhaust gases are drawn into and expand the cavitation bubble, as indicated in FIG. 5, in which the numeral 7 identifies a propeller blade and the numeral 8 identifies the cavitation bubble on the suction side of the blades.

The cowl 5 may be stationarily mounted around the opening 4, wherein a throttle plate (not shown) provided with control means controls the amount of gas released through the opening 4 to the propeller. Alternatively, the cowl 5 may be pivotally mounted or replaced with a pivotable flap 9 without side walls, as indicated in FIG. 2. In this latter case, the amount of gas that passes through the opening 4 is controlled by varying the opening angle of the flap 9, with the aid of control means, not shown. The settings of the throttle plate or flap can be adjusted with the aid of a control cable or an electrically or pressure-controlled servomotor, either manually or automatically by means of an electronic control device, such as to enable the extent to which the throttle plate/flap is open during acceleration of the boat to be varied successively, so that at each speed of the boat there is supplied an amount of gas which will maximize the propeller thrust. The throttle plate/flap is practically closed, or preferably fully closed, at full throttle.

In the case of the FIG. 4 embodiment, the cowl 5 is fitted directly to the bottom 10 of the boat. The invention can also be applied to a propeller leg of the S-drive type (not shown), in which case an outlet is placed directly in the propeller leg before the blade tips. The outlet may also be arranged in a flow body (not shown) which is located immediately in front of the propeller and extends downwardly from the blade tip over a minor part of the blade.

I claim:

1. An arrangement for boat propellor installations, comprising gaseous supply means for supplying a gaseous medium to the vicinity of a propeller whose blades pass close to a wall structure of said boat, said gaseous supply means including an outlet in said wall structure positioned forward of the tips of said propellor and said outlet including guide means to direct said flow of said gaseous medium rearwardly and radially inwardly towards said sweep of said propellor tips, said guide means being movable from a position in which said outlet is completely closed to a position in which said outlet is completely open to serve as a means to control the amount of gaseous medium supplied by said gaseous supply means.

2. The arrangement of claim 1 wherein said gaseous supply means is located in a horizontal wall structure of said boat.

3. The arrangement of claim 1 wherein said guide means comprises a flap pivotable about said opening.

* * * * *